US005092593A

United States Patent [19]

Williams et al.

[11] Patent Number: 5,092,593

[45] Date of Patent: Mar. 3, 1992

[54] VISUAL AID AND PROTECTIVE DEVICE FOR RACQUETS

[76] Inventors: Brian N. Williams, 3396 E. Antler Way, Salt Lake City, Utah 84121; Robert N. Williams, 438 Woodbridge, San Luis Obispo, Calif. 93401

[21] Appl. No.: 663,743

[22] Filed: Mar. 4, 1991

Related U.S. Application Data

[63] Continuation of Ser. No. 535,320, Jun. 8, 1990, abandoned.

[51] Int. Cl.[5] ..... A63B 49/14

[52] U.S. Cl. ..... 273/73 R; 273/73 C

[58] Field of Search ..... 273/73 R, 73 C, 73 D, 273/67 R, 67 DB

[56] References Cited

FOREIGN PATENT DOCUMENTS

| | | | |
|---|---|---|---|
| 29305 | 9/1930 | Australia | 273/73 C |
| 252293 | 5/1926 | United Kingdom | 273/73 C |
| 751040 | 6/1956 | United Kingdom | 273/73 C |

OTHER PUBLICATIONS

"Strip Protects Edge of Racket", The Sporting Goods Dealer, May 1975, p. 144, Protect-A-Tip advertisement, (admitted prior art) no date.

*Primary Examiner*—William H. Grieb
*Assistant Examiner*—William E. Stoll
*Attorney, Agent, or Firm*—J. David Nelson; Michael D. McCully

[57] ABSTRACT

A combination visual aid and protective device for use on the string end of a game racquet frame, the device being constructed of a thin, light-weight, brightly colored vinyl material that is predisposed to assume an arcuate shape that intimately conforms to the complex curved surface of the game racquet frame, in a manner to prevent the device from slipping relative to the frame.

The device includes a plurality of stress relief holes that function to permit the device to conform to the racquet frame surface and to reduce its weight as much as possible.

The visual aid and protective device is attached to the string end of the game racquet frame by a plurality of plastic coated wire-like attachment devices having generally rectangular cross-sections. These attachment devices engage corresponding, generally oval attachment holes in opposite attachment tabs of the protective device, in a manner to distribute the force (stress) of the attachment devices across more surface area of the holes in order to permit a tighter contact of the device with the racquet frame, without causing the attachment devices to tear through the tabs at the attachment holes.

29 Claims, 2 Drawing Sheets

VISUAL AID AND PROTECTIVE DEVICE FOR RACQUETS

This is a continuation of application Ser. No. 07/535,320, filed June 8, 1990, now abandoned.

BACKGROUND OF THE INVENTION

1. Field of the Invention

The present invention relates generally to devices for protecting the string end of a game racquet from damage during use, and more particularly to a removable protective device which is lightweight, abrasion-resistent, and brightly colored in order to function as a visual aid to the user for enabling the user to more accurately judge the location of the end of the racquet vis-a-vis the ball or other playing object to be struck, and vis-a-vis the playing surface.

2. Description of the Prior Art

Existing protective devices for attachment to the string ends of game racquets have major shortcomings that prevent their widespread use in the industry. Some existing devices add 14 grams or more to the weight or a racquet; current tennis enthusiasts regard weight additions over 9 grams to be substantial and undesirable. Some devices clip-on and then inadvertently snap off during play. Other devices twist and move around the frame during play. Yet, other devices are difficult to install (due to their lacing, for instance) and are not considered attractive.

A relatively new and very popular "wide body" racquet has a frame that enhances the racquet stiffness while providing an excellent aerodynamic shape. Existing racquet frame protective covers add 20 to 50 percent to the racquet frame dimension, thereby substantially impairing the designed aerodynamic advantage of the "wide body" racquet frame. In addition, many existing protective devices, being contoured for specific racquet frame configurations, are simply not attachable to the "wide body" racquet frames.

Several devices have been proposed to protect racquet frames from damage. A typical device, shown in U.S. Pat. No. 4,019,736, is a one-piece plastic member comprising a central strip and side fingers adapted to snap over the inner edges of the frame, thereby holding the central strip in place on the frame. Although the device appears workable, it has not been popular, due to the limited racquet width and number of models on which it can be attached. Being made of formed plastic material, these snap-on devices do not intimately conform to irregularities in the racquet frame surfaces. This reduces the frictional shear resistance contact between the snap-on device and frame surface, resulting in the device slipping and otherwise sliding around the racquet frame. Such a snap-on plastic protective device, being loosely snapped onto a racquet frame, will generally rattle upon impact with the ball. Additionally, such a formed plastic device exhibits poor abrasion resistance characteristics.

Another snap-on device that suffers the same disadvantages is shown in British Patent 751,040. A frame mounted, taped on, cushion device is shown in U.S. Pat. No. 4,192,506. It suffers from the same disadvantages inherent in the plastic body, as in the previously described clip-on type devices. Another frame mounted device is shown in U.S. Pat. No. 3,330,560. This "Tennis Racket With Weight Attachment" may also be considered a protective device, however with numerous shortcomings. It would appear that the device would need to be made of a relatively sturdy material in order to support the weights and force they exert, thus adding additional weight. The grommets would likely cause scarring of the racquet frame, and the use of lace mounting is very time consuming to install.

A more recent device, which is a predecessor to the present invention, comprises a relatively thick vinyl member retained on the curved string end of the racquet frame by monofilament lacing material. This device is necessarily thick in order to provide the structural integrity sufficient to prevent the monofilament lace from ripping through the lacing attachment holes. This contributes significantly to the weight of the protective device, and therefore the weight and potential resulting imbalance of the racquet itself. Lacing such a device to the racquet frame also is time-consuming and awkward when attempting to retain the device in position while threading and tightening the lacing.

SUMMARY OF THE INVENTION

The present invention comprises a thin, lightweight, brightly colored protective device having an elongate body portion formed of a material having a predisposition to assume an arcuate configuration that readily conforms to the string end of a game racquet frame. The elongate body portion includes a number of stress relief holes that (1) permit the device to conform to the complex curved end surface of the racquet frame, and (2) contribute to weight reduction of the device. The device is removably attached to the racquet frame by a plurality of elongate, wire-like attachment devices. Each attachment device has a generally rectangular cross section that defines opposite flat surfaces, and is adapted to hook into corresponding, opposed elongate attachment holes in the body portion. The essentially flat surfaces of the attachment devices that engage corresponding surfaces of the elongate attachment holes do so in a manner to distribute the retaining force across an increased surface area to prevent the attachment devices from tearing through the edge of the material adjacent the attachment holes. In this manner, (1) the protective device may be constructed of a much thinner material resulting in a much lighter weight protective device, and (2) the attachment holes may be located much closer to the peripheral edge of the body portion, thereby decreasing the mass of the body portion material necessary, and therefore decreasing the overall weight of the protective device.

A first embodiment of the wire-like attachment devices comprises a plurality of essentially parallel wires encapsulated in a plastic material. A second embodiment attachment device comprises a thin metal strip having a generally rectangular cross section, this strip being coated with or otherwise encapsulated in plastic for covering sharp edges of the metal strip to prevent the strip from cutting into the protective device at the attachment holes. The plastic coating also prevents the inner wires/metal strip from scratching or marring the surface of the racquet frame.

DETAILED DESCRIPTION OF THE INVENTION

Figure 1:
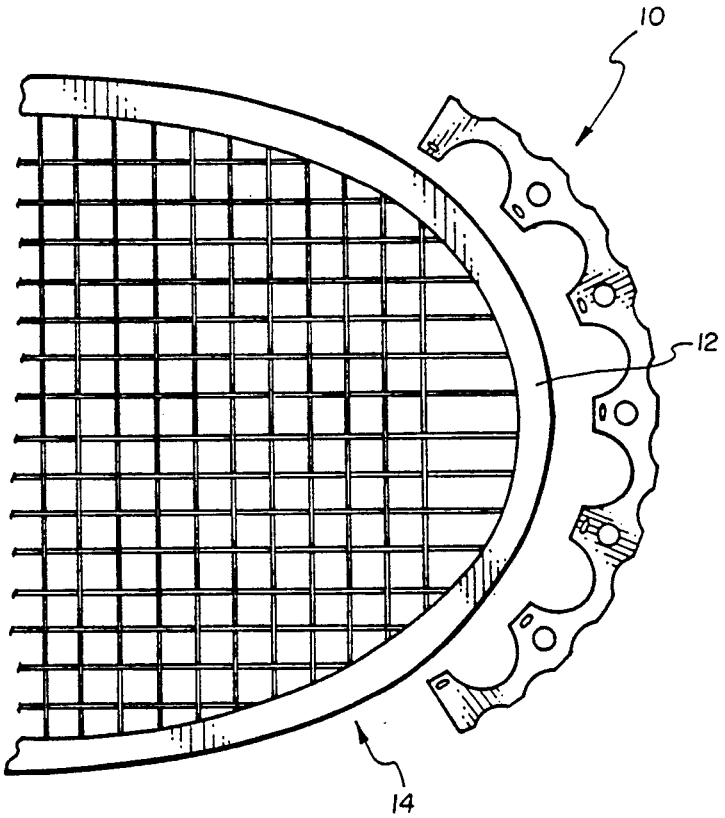
FIG. 1 is a partial front view of a string frame of a typical game racquet, as in a tennis racquet, illustrating the location and orientation of the visual aid and protective device of the present invention.

Turning now to the drawings and initially to FIG. 1, the visual aid and protective device for racquets of the present invention is shown generally illustrated at 10. The protective device is adapted to fit onto the curved end 12 of a tennis racquet 14 or the like. In this preferred embodiment, the protective device 10 is predisposed to assume an arcuate shape (1) generally in its longitudinal direction, and (2) generally in the direction transverse to its longitudinal direction, so that the protective device will conform naturally to the complex curved end 12 of the racquet string frame. In this regard, the protective device 10 is constructed of a vinyl material that has been predisposed to the aforementioned arcuate shapes.

The inventors have found that a preferred way of manufacture of the protective device 10 is to manufacture it from vinyl tubing of suitable diameter, wall thickness, and durometer, by initially slitting the tubing in the longitudinal direction along the inside radius of the tubing as it is rolled off of a spool. Those skilled in the art will readily appreciate that manufacturing a protective device 10 in such a manner from vinyl tubing results in an elongate device having an inherent predisposition to assume the above-mentioned arcuate shapes. Likewise, of course, the protective device 10 could be punched out of flat, sheet vinyl and subsequently formed and treated (heated, for example) in order to impart the desired predisposition to assume the arcuate shapes.

Figure 2:
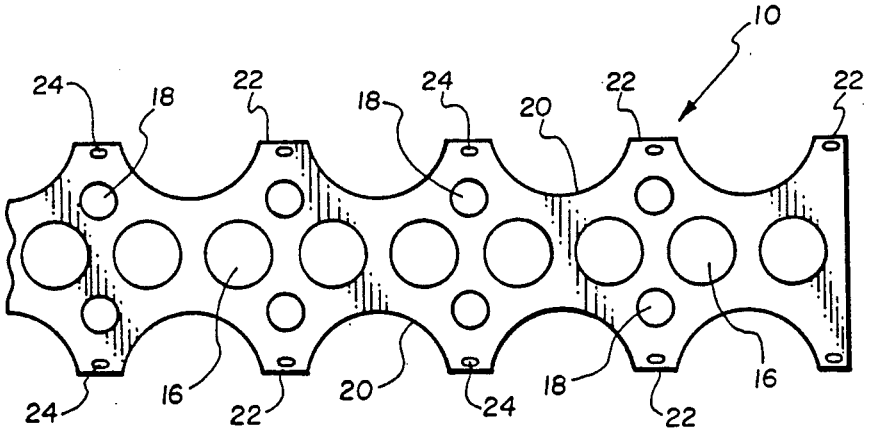
FIG. 2 is a partial plan view of the combination visual aid and protective device of the present invention.

FIG. 2 is a partial plan view of the protective device 10 of the present invention shown in a flattened out state as it would be without the above-mentioned tendencies to assume the arcuate shapes. As shown, the protective device 10 includes a plurality of first stress relief holes (the larger holes) 16 that are positioned generally along the longitudinal central axis (not specifically indicated) of the protective device. As will be explained in greater detail below, these first stress relief holes 16 function to (1) permit the protective device to conform to various configurations of racquet string frame ends and additionally, (2) remove excess material from the protective device in order to render the protective device as lightweight as possible.

The visual aid and protective device also includes a plurality of second stress relief holes 18 located generally in a pattern symmetric about the longitudinal central axis, and generally on each side of the pattern of first stress relief holes 16. These second stress relief holes 18 function in a manner identical to the first stress relief holes 16 to (1) permit the protective device to conform to various configurations of racquet string frame ends, and (2) remove material from the protective device in order to decrease its weight. In this regard, the inventors have determined that the present invention weighs approximately 6.5 grams.

The visual aid and protective device is formed with a plurality of semi-circular cutouts 20, which are symmetric about the longitudinal central axis of the device. These cutouts 20 function identically to the first and second stress relief holes to permit the protective device to conform to racquet string frame ends and decrease the weight of the device. As shown, the cutouts 20 define a plurality of tabs 22, each containing an elongate attachment hole 24 for attaching the protective device to the curved end of a racquet string frame, as will be explained in greater detail hereinbelow.

Figure 3:
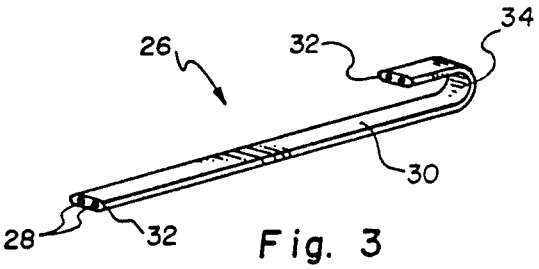
FIG. 3 is a perspective view of a first embodiment of an attachment device for attaching the protective device to a game racquet string frame.

FIG. 3 is a perspective view of a first embodiment of an elongate, wire-like attachment device 26 for attaching the protective device 10 to a racquet string frame. The attachment device 26 is constructed of two generally parallel small metal wires 28 encapsulated in a plastic material 30, similar to what is commonly known in the trade as a "wire tie". As shown, the attachment device 26, however, includes two metal wires, as opposed to a single wire found in common "wire ties". Of course, the attachment device 26 could also have three or more small metal wires, if desired.

The attachment device 26 has an overall generally rectangular cross section that is essentially flat on two opposite sides. Due to this particular shape, the attachment device 26 cooperates with the elongate attachment holes 24 in the protective device body portion to distribute the retaining force (i.e., stress) across essentially the entire surface of the inside of the attachment hole. Those skilled in the art will readily appreciate that such a distribution of retaining force across a surface is a substantial improvement over devices of the kind that utilize a circular cross section string or lacing through circular holes to retain the particular object in place that impart concentrated point stresses to the material at the circular holes. This enables the visual aid and protective device to be attached much more tightly to the string frame without causing the attachment devices to tear or rip loose at the attachment holes.

The attachment device 26 additionally includes rounded edges 32 formed in the plastic material 30 to more uniformly engage the attachment holes 24 and prevent the small metal wires 28 from cutting into the vinyl material of the protective device body portion. As shown, the attachment device is preformed with a "J" hook 34 at one end to facilitate installing the visual aid and protective device.

Figure 4:
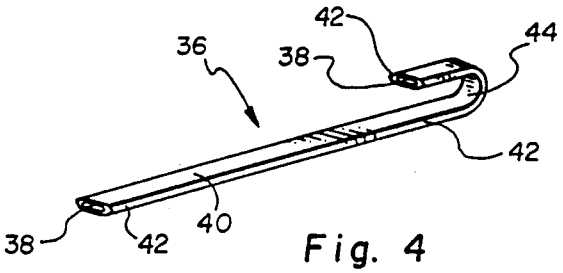
FIG. 4 is a perspective view of a second embodiment of an attachment device for attaching the protective device to a game racquet string frame.

FIG. 4 is a second embodiment 36 of an elongate, wire-like attachment device for attaching the visual aid and protective device to a racquet string frame. This attachment device 36 is constructed of a thin metal strip 38 encapsulated in a plastic material 40 in a manner to define a more or less rectangular cross section to the attachment device. The plastic material also includes rounded edges 42 that conform to the elongate attachment holes 24 in the protective device, and serve to prevent the otherwise sharp edges of the thin metal strip from cutting into the vinyl material of the protective device body portion.

As in the first embodiment of the attachment device 26, this second embodiment 36 includes opposite flat surfaces, the engaging surface of which functions to distribute the retaining force across the inside surface of the particular elongate attachment hole 24 of the protective device. This second embodiment 36 also includes a "J" hook 44 preformed in one end to facilitate installation.

Figure 5:
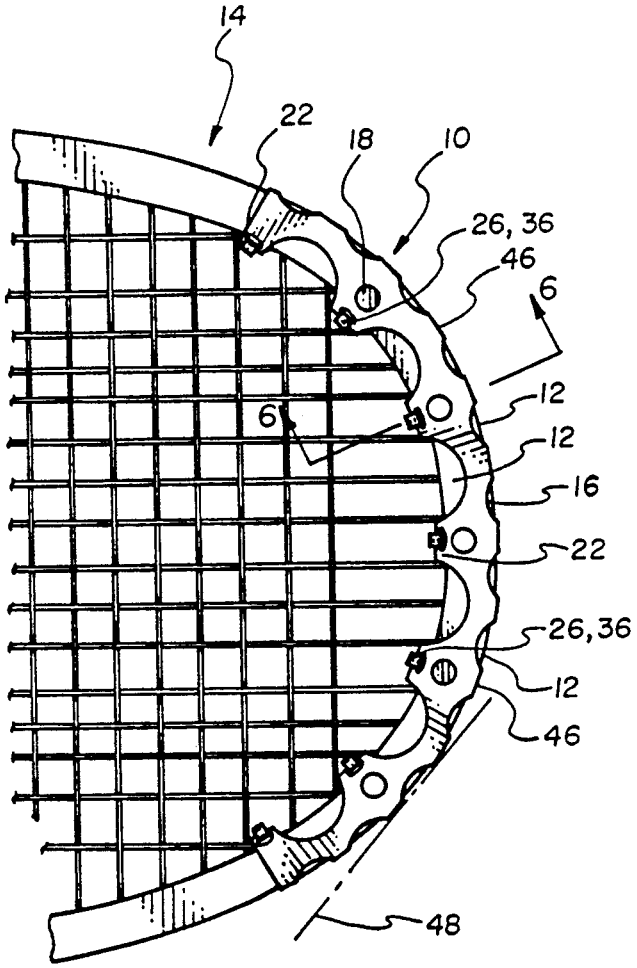
FIG. 5 is a partial front view of a string frame of a game racquet, showing the visual aid and protective device of the present invention in functional position on the end of the racquet frame.

FIG. 5 is a partial front view of a racquet string frame, showing the visual aid and protective device of the present invention in functional position attached to the curved end 12 of the racquet frame. As shown, the tabs 22 of the protective device are designed to fit between the particular strings of the racquet frame string network. The protective device is secured in place on the end of the racquet frame by the attachment devices 26 or 36, to retain the protective device securely in its functional position on the curved end of the racquet string frame.

Those skilled in the art will appreciate that the size of the first stress relief holes 16 is determined such that the amount of the frame curved end 12 that is exposed through the relief holes 16 is small enough that the frame curved end is protected by transverse strips 46 formed between the first stress relief holes, in the event the curved end of the racquet frame strikes a flat surface, such as a tennis court or racquetball court floor or wall. In other words and with reference to FIG. 5, the first stress relief holes 16 are small enough that the transverse strips of material 46 between adjacent holes are close enough together that the curved end 12 of the frame does not extend beyond an imaginary plane 48 placed over any one of the first stress relief holes 16 and in contact with the two adjacent transverse strips of material 46. In this manner, the curved end 12 of the racquet frame is always protected from damage when the racquet strikes the flat playing surface of the particular court.

The visual aid and protective device of the present invention is made of a brightly colored vinyl tubing material, approximately 0.033 inches thick. The inventors have determined that such material of this thickness is optimum for (1) protection of the racquet frame from damage, (2) adding minimal weight and combined frame thickness to the racquet, and (3) providing sufficient structural integrity to the protective device to prevent failure or tearing at the attachment holes. In this regard, the present invention adds only approximately 10 percent to the overall frame thickness (cross-sectional height), and only approximately 6.5 grams to the overall combined weight of the racquet and protective device.

The inventors have also determined that an optimum durometer for the vinyl material is in the range of 50–75. Materials of less that 50 or so durometer tend to be too elastic and deform too easily under shear, as when the game racquet strikes a rough, friction-like playing surface. Materials of greater than 75 or so durometer have difficulty in conforming to the complex curved surfaces and other surface irregularities of game racquet string frames, and also exhibit poor abrasion characteristics.

Because of its capacity as a visual aid device, the present protective device is made of a brightly colored material that contrasts with the ball and with the court or playing surface. The inventors have determined that bright fluorescent colors (pink, orange, etc.) function quite well to aid the user in determining the exact location of the end of his racquet vis-a-vis both the ball and court surface or wall during play. By so doing, the visual aid and protective device serves to assist the user to more consistently hit the ball with the "sweet spot" of his racquet, thus considerably improving his ball control and overall performance, while simultaneously causing him to strike the court surface or wall much less frequently, and protecting his racquet from damage when he does inadvertently strike the court surface or wall. The vinyl material may be colored in any conventional manner, as for example, by impregnation.

Figure 6:
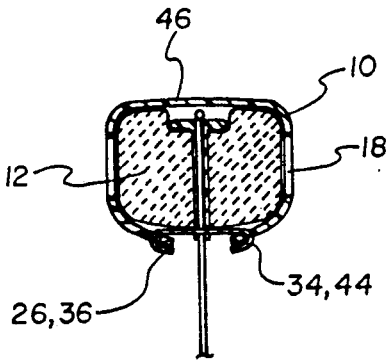
FIG. 6 is a cross-sectional view taken along lines 6—6 in FIG. 5, showing the visual aid and protective device attached to a typical racquet string frame.

FIG. 6 is a cross-sectional view taken along line 6—6 in FIG. 5. It illustrates how the visual aid and protective device 10 wraps around the complex curved end 12 of the racquet frame, and is retained in functional position thereon by the attachment devices 26 or 36. Those skilled in the art will readily appreciate that a preferable way of attaching the protective device to the end of the racquet frame is to, (1) initially hook the "J" hook end 34 or 44 of the attachment device into one of the elongate attachment holes 24, (2) insert the other end of the attachment device through the corresponding attachment hole in the opposing tab 22 of the protective device, and (3) bend the excess material of the attachment device back toward the first "J" hook end in order to result in two opposite hook ends of the attachment device holding the protective device body portion in position, as shown in FIG. 6.

In this regard, it will be appreciated that using the attachment devices 26, 36 to attach the visual aid and protective device to the end of a racquet frame is much simpler and easier than attempting to attach such a device by a single string or lacing. This is because the device can be securely attached to the racquet frame at each set of corresponding tabs 22, sequentially and beginning at the center for instance, as opposed to attempting to maintain the device in correct position while trying to tighten a single lacing strand through the entire length of the device. Additionally, once the visual aid and protective device has been attached to the racquet frame, it can easily be tightened (post-tensioned) or otherwise adjusted incrementally, again, sequentially or selectively, without coming loose altogether, as would happen with a lace-attached device. Either after the protective device has been completely hooked in position on the racquet frame, or after the excess material pieces of the attachment devices have been bent back toward the first hook ends 34, 44 sufficiently to prevent the particular protective device tab 22 from slipping off, the user can easily clip the excess material of the attachment devices with small wire cutters, scissors, or a fingernail clipper.

FIG. 6 also clearly illustrates that the present visual aid and protective device readily conforms to the surface contour of the racquet frame without forming any voids in the surface contact between the two, as when for example, a stiffer and/or thicker plastic sheet is "wrapped" around a sharp corner. This is due to the combination of (1) the thinner vinyl material that can be used, and (2) the flexibility inherent in vinyl materials of the specified thickness and durometer. The effects of this uniform contact between the racquet frame surface and the vinyl material of the visual aid and protective device are: (1) essential elimination of relative movement between the racquet frame surface and the vinyl material device; and (2) lower overall profile of the racquet frame and protective device, resulting in a negligible increase in wind resistance in the racquet frame.

Figure 7:
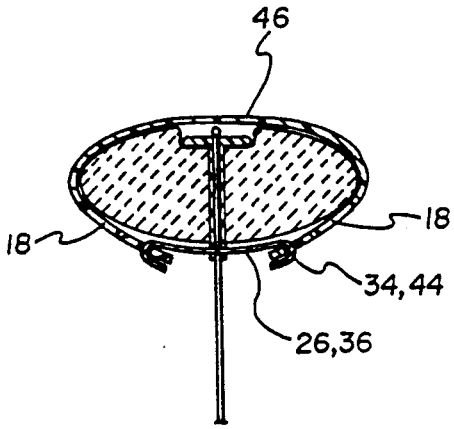
FIG. 7 is a cross-sectional view similar to FIG. 6, showing the visual aid and protective device attached to a "wide body" tennis racquet frame.

FIG. 7 is a cross-sectional view similar to FIG. 6, showing a different construction of the curved string frame of a game racquet. The racquet frame shown in FIG. 7 is commonly referred to as a "wide body" frame, and is intended to provide increased structural integrity in the frame by virtue of its increased size and mass. In order to make these "wide body" racquet frames more desirable, however, the cross sectional height (vertical distance as shown in FIG. 7) has been decreased considerably, and the frame itself rounded considerably in order to form a more aerodynamically desirable shape. Those skilled in the art will readily appreciate that the visual aid and protective device of the present invention can easily be adapted to "wide body" game racquet frames by simply increasing the width of the device such that the two opposed tabs 22 are sufficiently close together to be connected by the attachment devices 26, 36 as shown in FIG. 7. The procedure for attaching the visual aid and protective device of the present invention to these "wide body" game racquet frames is identical to that previously described in relation to FIG. 6.

What is claimed is:

1. A combination visual aid and protective device for removable attachment to the curved end portion of a game racquet having a handle and a string network, said combination visual aid and protective device comprising:

(a) a thin, lightweight, brightly colored, pliant, generally elongate body portion formed of a material having a predisposition to assume an arcuate shape (i) generally in its longitudinal direction, and (ii) generally in the direction transverse to its longitudinal direction, said body portion including a plurality of first stress relief holes generally along the longitudinal center of said body portion, and a plurality of second stress relief holes oriented generally in a pattern on each side of said first stress relief holes, all of said stress relief holes for permitting said device to conform to a racquet curved end surface, and a plurality of generally elongate attachment holes located symmetrically about the longitudinal center of said body portion adjacent respective longitudinal edges of said body portion; and (b) a plurality of attachment devices, each comprising a length of malleable structural material having a generally rectangular cross section, said attachment devices for passing through opposing said elongate attachment holes, and being bendable to form two hook portions, in a manner to secure said combination visual aid and protective device about a racquet frame curved end portion.

2. A combination visual aid and protective device as set forth in claim 1, wherein said body portion material is highly abrasion resistant.

3. A combination visual aid and protective device as set forth in claim 1, wherein the thickness of said body portion material is approximately 0.033 inches.

4. A combination visual aid and protective device as set forth in claim 1, wherein each of said attachment devices comprises a plurality of generally parallel metal wires, encapsulated in a plastic material in a manner to distribute the retaining force of said attachment devices across essentially the entire surface of said attachment holes.

5. A combination visual aid and protective device as set forth in claim 1, wherein each of said attachment devices comprises a thin metal strip having a generally rectangular cross section, said metal strip being coated with a plastic material in a manner to cover the sharp longitudinal edges of said metal strip.

6. A combination visual aid and protective device as set forth in claim 1, wherein each of said attachment devices provides incremental adjustability to said visual aid and protective device.

7. A combination visual aid and protective device as set forth in claim 1, wherein said device substantially conforms with racquet frame irregularities, thereby providing intimate contact with a racquet frame curved end portion.

8. A combination visual aid and protective device as set forth in claim 1, wherein said device is impregnated with a very brilliant color to plainly accent a racquet frame curved end portion.

9. A combination visual aid and protective device as set forth in claim 1, wherein said device is highly visible to game racquet users.

10. A combination visual aid and protective device as set forth in claim 1, wherein said device comprises non-resilient, highly pliant and abrasion resistant tubing.

11. A combination visual aid and protective device as set forth in claim 1, wherein said device has a low profile whereby little appreciable wind resistance is added to a racquet.

12. A combination visual aid and protective device for removable attachment to the curved end portion of a game racquet having a handle and a string network, said combination visual aid and protective device comprising:

(a) a thin, lightweight, pliant, non-resilient generally elongate body portion formed of a material that contrasts with the color of game balls and playing surfaces, said material having a predisposition to assume an arcuate shape generally in the direction transverse to its longitudinal direction and conforming with racquet frame irregularities, said body portion including a plurality of attachment holes located adjacent respective longitudinal edges of said body portion; and (b) a plurality of attachment devices for passing through opposing said attachment holes in a manner to secure said combination visual aid and protective device about a racquet frame curved end portion.

13. A combination visual aid and protective device as set forth in claim 12, wherein said body portion material is highly abrasion resistant.

14. A combination visual aid and protective device as set forth in claim 12, wherein each of said attachment devices comprises a plurality of generally parallel metal wires, encapsulated in a plastic material in a manner to distribute the retaining force of said attachment devices across essentially the entire surface of said attachment holes.

15. A combination visual aid and protective device as set forth in claim 12, wherein each of said attachment devices comprises a thin metal strip having a generally rectangular cross section, said metal strip being coated with a plastic material in a manner to cover the sharp longitudinal edges of said metal strip.

16. A combination visual aid and protective device as set forth in claim 12, wherein each of said attachment devices provides incremental adjustability to said visual aid and protective device.

17. A combination visual aid and protective device as set forth in claim 12, wherein said device substantially conforms with racquet frame irregularities, thereby providing intimate contact with a racquet frame curved end portion.

18. A combination visual aid and protective device as set forth in claim 12, wherein said device is brilliantly colored to plainly accent the racquet frame curved end portion.

19. A combination visual aid and protective device as set forth in claim 12, wherein said device is highly visible to game racquet users.

20. A combination visual aid and protective device as set forth in claim 12, wherein said device comprises non-resilient, highly pliant and abrasion resistant tubing material.

21. A combination visual aid and protective device as set forth in claim 12, wherein said device has a low profile whereby little appreciable wind resistance is added to a racquet.

22. A combination visual aid and protective device as set forth in claim 12, wherein said body portion includes a plurality of first stress relief holes for permitting said device to conform to a racquet curved end surface.

23. A combination visual aid and protective device as set forth in claim 22, wherein said plurality of first stress relief holes are located generally along the longitudinal center of said body portion.

24. A combination visual aid and protective device as set forth in claim 23, wherein said body portion further includes a plurality of second stress relief holes oriented generally in a pattern on each side of said first stress relief holes.

25. A combination visual aid and protective device as set forth in claim 12, wherein said generally elongate body portion is formed of a material having a predisposition to assume an arcuate shape generally in its longitudinal direction.

26. A combination visual aid and protective device as set forth in claim 12, wherein said body portion attachment holes are generally elongate.

27. A combination visual aid and protective device as set forth in claim 12, wherein each of said attachment devices comprises a first hook portion on one end thereof, and at least a second opposing hook portion on the opposite end thereof.

28. A combination visual aid and protective device as set forth in claim 12, wherein each of said attachment devices comprises a length of malleable structural material.

29. A combination visual aid and protective device as set forth in claim 12, wherein each of said attachment devices comprises a preformed structural material having at least one hook portion on each end thereof when said attachment device is in functional position upon a game racquet.

* * * * *

UNITED STATES PATENT AND TRADEMARK OFFICE

CERTIFICATE OF CORRECTION

PATENT NO. : 5,092,593

DATED : March 3, 1992

INVENTOR(S) : Brian N. Williams; Robert N. Williams

It is certified that error appears in the above-identified patent and that said Letters Patent is hereby corrected as shown below:

Column 8, lines 11-12, "impregnated with a very brilliant color" should be --brilliantly colored--;

Column 8, line 19, "tubing." should be --tubing material.--;

Column 8, line 29, a --,-- should follow "non- resiliant"; and

Column 9, line 3, "the" should be --a--.

Signed and Sealed this

Twenty-first Day of September, 1993

Bruce Lehman

*Attest:*

BRUCE LEHMAN

*Attesting Officer*

*Commissioner of Patents and Trademarks*